US012226686B2

(12) United States Patent
Løvfold Grønfeldt

(10) Patent No.: US 12,226,686 B2
(45) Date of Patent: Feb. 18, 2025

(54) PLAY STRUCTURE WITH A MESH PANEL

(71) Applicant: KOMPAN A/S, Odense SØ (DK)

(72) Inventor: Peter Christian Løvfold Grønfeldt, Odense SØ (DK)

(73) Assignee: KOMPAN A/S, Odense SØ (DK)

( * ) Notice: Subject to any disclaimer, the term of this patent is extended or adjusted under 35 U.S.C. 154(b) by 366 days.

(21) Appl. No.: 17/753,407

(22) PCT Filed: Sep. 3, 2020

(86) PCT No.: PCT/EP2020/074550
§ 371 (c)(1),
(2) Date: Mar. 2, 2022

(87) PCT Pub. No.: WO2021/043877
PCT Pub. Date: Mar. 11, 2021

(65) Prior Publication Data

US 2022/0288438 A1 Sep. 15, 2022

(30) Foreign Application Priority Data

Sep. 3, 2019 (DK) ..... PA 2019 70553

(51) Int. Cl.
*A63B 9/00* (2006.01)
*A63B 69/00* (2006.01)
*A63G 21/00* (2006.01)

(52) U.S. Cl.
CPC ..... *A63B 9/00* (2013.01); *A63B 69/0048* (2013.01); *A63B 2009/006* (2013.01)

(58) Field of Classification Search
CPC ..... A63G 21/00; A63B 9/00; A63B 17/00; A63B 69/0048
(Continued)

(56) References Cited

U.S. PATENT DOCUMENTS 6,165,106 A 12/2000 McBride et al.
6,569,023 B1 * 5/2003 Briggs ..... A63B 9/00 472/117
(Continued)

FOREIGN PATENT DOCUMENTS

CA 3023940 A1 11/2017
DE 202008002562 U1 6/2008
(Continued)

OTHER PUBLICATIONS

International Search Report and Written Opinion issued in International Application PCT/EP2020/074550 on Dec. 2, 2020 (11 pages).
(Continued)

*Primary Examiner* — Kien T Nguyen
(74) *Attorney, Agent, or Firm* — Bookoff McAndrews, PLLC

(57) ABSTRACT

A play structure for children, including two vertically arranged pillars and a first vertically arranged panel element connected between the two pillars, said two vertically arranged pillars each being longer than 2 m and said first vertically arranged panel element being arranged such that its upper edge is located higher than 2 m from the bottom of the two vertically arranged pillars. The first vertically arranged panel element comprises a rectangular frame comprising a top and a bottom horizontally arranged frame member and a left and a right vertically arranged frame member, said top, bottom, left and right frame members together defining an enclosed area, said enclosed area being greater than 0.5 m2 and said enclosed area being filled with a mesh structure made from elongated metal elements arranged in a repeating pattern, each of the elongated metal elements being fastened to at least two different frame members.

18 Claims, 5 Drawing Sheets

(58) Field of Classification Search
USPC ..... 472/116, 136; 482/34, 35, 36
See application file for complete search history.

(56) References Cited

U.S. PATENT DOCUMENTS

| | | | | |
|---|---|---|---|---|
| 2006/0079379 | A1 | 4/2006 | Zeilinger et al. | |
| 2007/0082791 | A1 | 4/2007 | Reese et al. | |
| 2007/0267560 | A1* | 11/2007 | Robertson | A63G 21/00 248/560 |
| 2013/0178299 | A1* | 7/2013 | Kopp | A63G 9/00 472/136 |
| 2018/0028852 | A1* | 2/2018 | Beaver | A63B 71/0036 |
| 2018/0126206 | A1 | 5/2018 | Wrolson et al. | |

FOREIGN PATENT DOCUMENTS

| | | | |
|---|---|---|---|
| GB | 817701 | A | 8/1959 |
| GB | 2293983 | A | 4/1996 |
| GB | 2482319 | A | 2/2012 |

OTHER PUBLICATIONS

Communication issued by the EPO in corresponding application EP20775820.2, issued May 21, 2024.

* cited by examiner

PLAY STRUCTURE WITH A MESH PANEL

CROSS-REFERENCE TO RELATED APPLICATION(S)

This patent application is the U.S. National Stage entry under 35 U.S.C. § 371 of International Patent Application No. PCT/EP2020/074550, filed on Sep. 3, 2020, which claims the benefit of priority to Denmark Patent Application No. PA 2019 70553, filed on Sep. 3, 2019, the entirety of which is incorporated herein by reference.

The current invention relates to a play structure for children. The play structure comprises at least two vertically arranged pillars and at least one vertically arranged panel element connected between the two pillars, said two vertically arranged pillars each being longer than 2 m and said vertically arranged panel element being arranged such that its upper edge is located higher than 2 m from the bottom of the two vertically arranged pillars.

DESCRIPTION OF RELATED ART

Play structures for children are well known in the art and come in very many different forms, sizes and shapes. They also have very many different formats and functions.

Since children like to climb upwards on such play structures, many play structures have a certain height which makes climbing fun. However, the higher the play structure, the greater will be the loads made on the play structure. These loads can come from the motion of the children playing on the structure as well as other external factors such as sun and wind. Especially wind loads have a large effect on play structures. In order to reduce the cost and weight of the structure, known play structures are kept relatively low in height to avoid the lever effect of wind loading on a tall structure.

SUMMARY OF THE INVENTION

It is therefore a first aspect of the invention to provide a play structure which can reduce wind loading on the structure in a cost effective manner.

It is a second aspect of the invention to provide a play structure which can reduce wind loading on the structure without reducing the strength of the structure.

These aspects are provided at least in part by a play structure as mentioned in the opening paragraph together with the features disclosed in the characterizing portion of claim 1. In this way, a play structure is provided which has mesh panels which allow wind to pass through the structure to thereby reduce the wind loads on the structure. The panels also provide strength to the structure and provide safety to the children in the structure by preventing them from falling out of the structure. Likewise, the mesh panels are formed such that fingers can't get caught in the structure.

According to this specification an object which is vertically arranged should be understood as an object having a longitudinal axis which forms an angle to the horizontal of greater than 60 degrees and less than or equal to 90 degrees. In one embodiment, the angle is greater than 80 degrees. In one embodiment the angle is 90 degrees.

In one embodiment, the diameter of the largest inscribed circle between adjacent frame members and/or metal elements is greater than 25 mm, greater than 22 mm, less than 10 mm or less than 8 mm. In one embodiment, the diameter of the largest inscribed circle between adjacent frame members and/or metal elements is less than or greater than 40 mm, 55 mm, 65 mm, 75 mm, 85 mm or 95 mm.

In one embodiment, the vertically arranged pillars are taller than 3 m, taller than 4 m or taller than 5 m. In one embodiment, the upper edge of the vertically arranged panel element is more than 3 m, more than 4 m or more than 5 m higher than the bottom of the vertically arranged pillars.

In one embodiment, the elongated metal elements are arranged at an angle to the frame members to which they are connected to of between 30 and 60 degrees. In this way, the elongated elements follow lines of tension in the panel and actively support the stiffness and strength of the panel. In one embodiment, the angle is between 40 and 50 degrees. In one embodiment, the angle is 45 degrees. In one embodiment, the rectangular frame has a height which is greater than or equal to its width.

In one embodiment, the elongated metal elements are extruded metal profiles. In one embodiment, the elongated metal elements are metal wires. In one embodiment, the area of the cross section of the elongated metal elements is greater than 4 mm2, greater than 7 mm2 or greater than 10 mm2. In one embodiment, the area of the cross section of the elongated metal elements is less than 30 mm2, less than 20 mm2 or less than 15 mm2. In one embodiment, the elongated metal elements have a circular cross section. In one embodiment, the elongated metal elements have a rectangular cross section. In one embodiment, the frame members comprise extruded and/or folded metal profiles. In one embodiment, the frame members are made from steel. In one embedment, the frame members are made from stainless steel. In one embodiment, the frame members are made from galvanized steel.

In one embodiment, the elongated metal elements comprise a first set of elongated metal elements extending in a first direction and a second set of elongated metal elements extending in a different direction, the angle between the elongated metal elements of the first and second set of elongated metal elements being between 60 and 90 degrees.

In one embodiment, the elongated metal elements are joined together where they cross each other so that the elongate metal elements do not displace with respect to each other at their point of crossing. Preventing relative motion between the elongated elements contributes to the strength of the panel, but also ensures that the size of the opening between adjacent elements does not get larger or smaller over time. If the holes were to get larger over time, then there would be danger of a child getting a body part caught in the structure. In one embodiment, the elongated metal elements are welded together where they cross each other. In one embodiment, the elongated metal elements are twisted metal cables which are spliced together at their point of crossing. In one embodiment the elongated metal elements are metal wires which are joined together with ferrules or another form of connector element at their crossing points. In one embodiment, the mesh structure is a metal wire net structure.

In one embodiment, the elongated metal elements are fastened to the frame members by welding. In one embodiment, the ends of the elongated metal elements are fasted to the frame members by welding.

In one embodiment, the play structure further comprises a second vertically arranged panel element, said second vertically arranged panel element comprising a panel of wood or plastic, said first and second vertically arranged panels both being provided with mounting fittings for attaching the panels to the pillars, the mounting fittings of the first and second vertically arranged panels being of the same kind such that the connection between the first panel and the pillars and the connection between the second panel and the pillars is formed in the same way.

In one embodiment, the first mesh panel is formed with a plurality of mounting holes arranged along the left and right side of the first panel and/or along the top and bottom of the first panel and in that the second panel is arranged with a plurality of mounting holes arranged along the left and right side of the second panel and/or along the top and bottom of the second panel and in the that horizontal distance between the mounting holes along the left and right sides of the first and second panels are the same and/or in that the vertical distance between the mounting holes along the top and bottom sides of the first and second panels are the same. In one embodiment, a vertical distance between two adjacent holes along the left or right sides of the first panel is the same as a vertical distance between two adjacent holes along the left or right sides of the second panel are the same.

The current specification also discloses a second invention which could provide the basis for a divisional application. This second invention relates to a play structure for children, comprising three vertically arranged pillars, two vertically arranged wall panels connected between the three pillars and a horizontally arranged floor panel connected between the three pillars, said floor panel being arranged below an upper edge of the two vertically arranged wall panels. The play structure is characterised in that at least one of the two vertically arranged wall plates comprises multiple spaced apart climbing holds to provide a climbing wall, said climbing holds are arranged on a surface of the vertically arranged wall panel which faces the other vertically arranged wall panel and/or which is arranged on the same side of the wall panel as the floor panel, said climbing holds are arranged above the floor panel, and in that said play structure comprises a fall cushioning element arranged on said floor plate.

In one embodiment, the panel to which the climbing holds are attached is a translucent panel. In one embodiment, the wall panel to which the climbing holds are attached is a transparent panel. In one embodiment, the wall panel to which the climbing holds are attached is a transparent panel with graphic prints on an outer or inner surface.

In one embodiment, a third panel is arranged along one side of the panel to which the climbing holds are attached, said third panel arranged at an angle of between 60 and 120 degrees to the climbing wall panel. In one embodiment, an opening is formed in the third panel through which a child can access the climbing wall. In one embodiment, a lower portion of the opening is arranged at least 1 m above the floor panel.

In one embodiment, the play structure further comprises a second floor panel arranged above the first floor panel, said second floor panel being arranged horizontally offset from the first floor panel or being provided with an opening such that a child can climb from the first floor panel to the second floor panel via the climbing wall. In one embodiment, the second floor panel is arranged at least 2 m above the first floor panel.

In one embodiment, the climbing wall is provided with two openings, through which a child can exit or enter the climbing wall, the two openings being provided at different heights from the floor panel.

In one embodiment, the highest climbing grip is located at least 2 m, at least 3 m or at least 4 m above the floor panel.

The current specification also discloses a play structure having both a mesh panel as described above and a climbing wall arrangement as described above.

It should be emphasized that the term "comprises/comprising/comprised of" when used in this specification is taken to specify the presence of stated features, integers, steps or components but does not preclude the presence or addition of one or more other features, integers, steps, components or groups thereof. For example, the current claim 1 claims two vertically arranged pillars, however this should be understood as at least two vertically arranged pillars.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
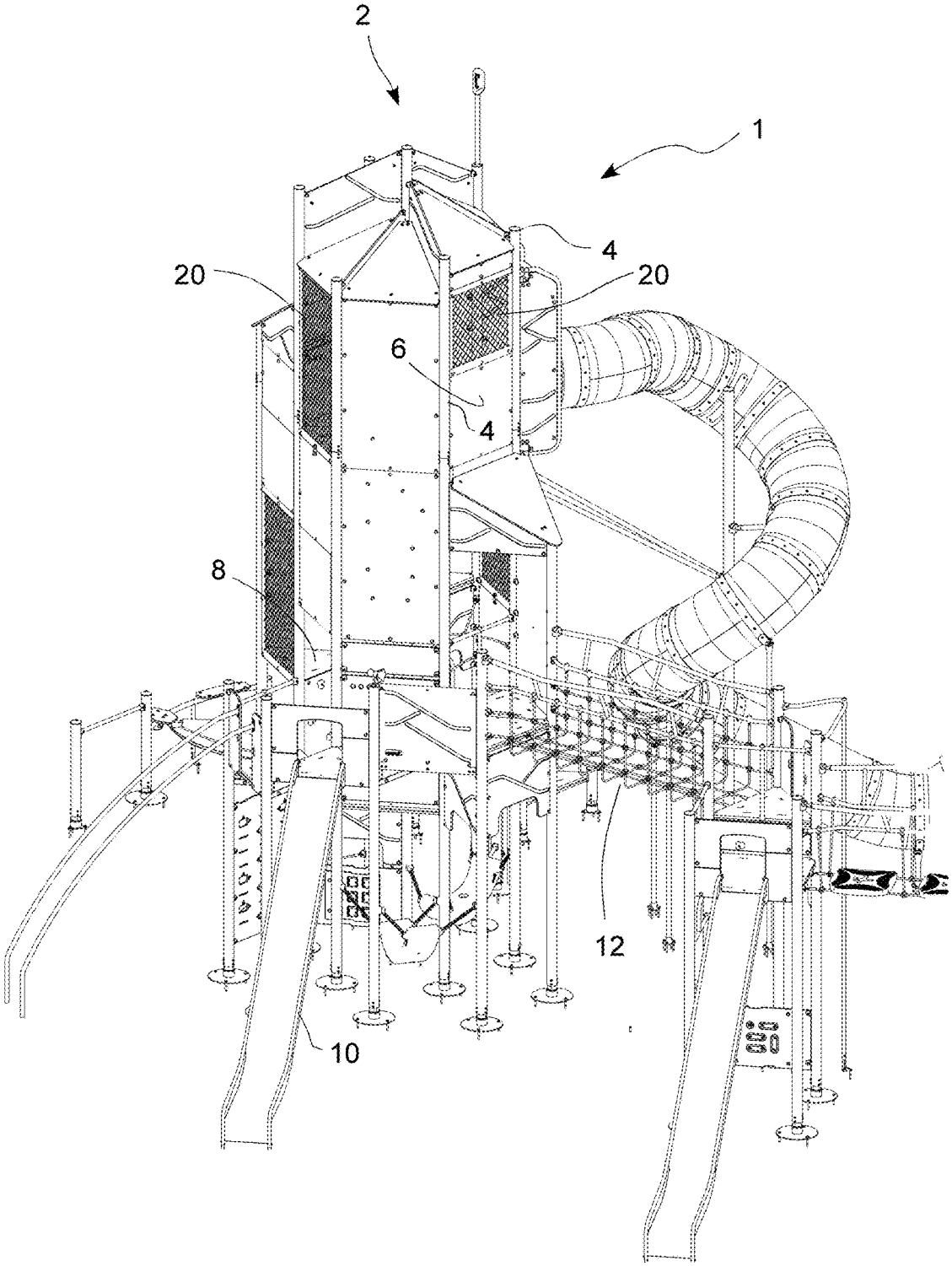
FIG. 1 shows a front top perspective view of a first embodiment of a play structure according to the current invention.
Figure 2:
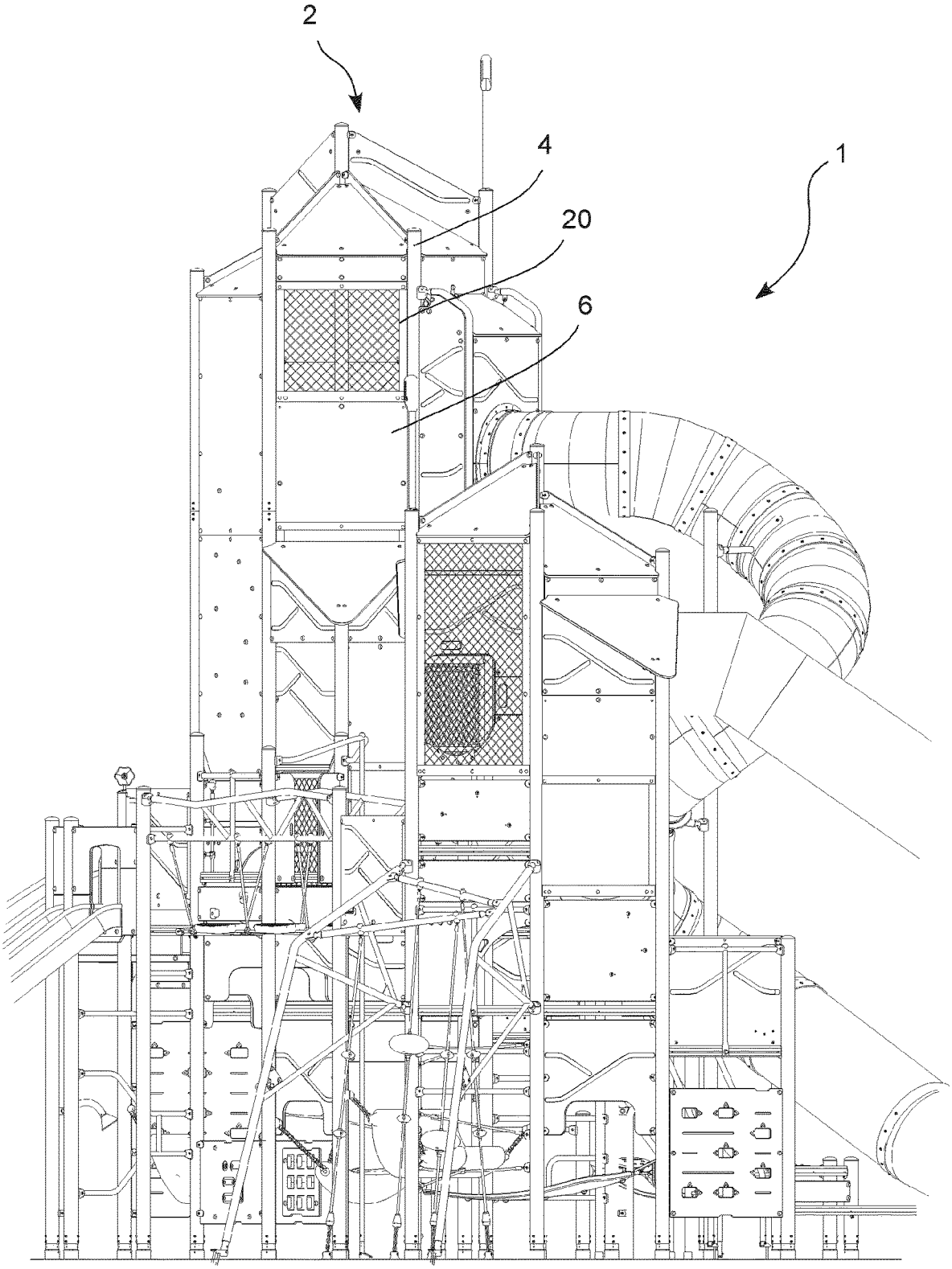
FIG. 2 shows a side view of the play structure of FIG. 1.
Figure 3:
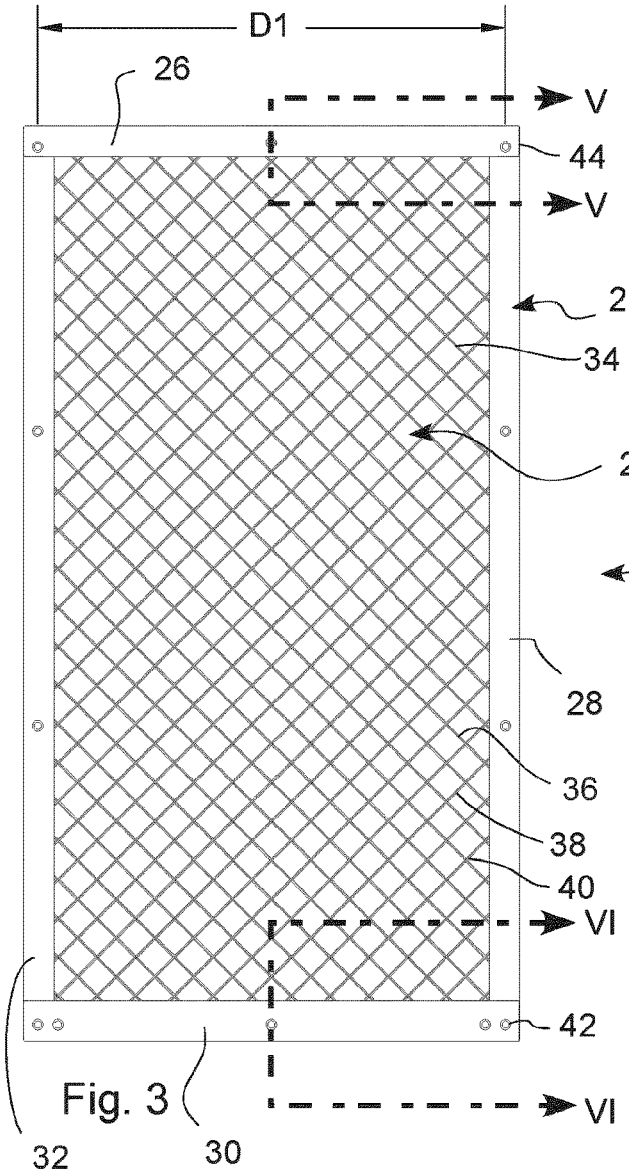
FIG. 3 shows a front view of a first embodiment of a panel element.
Figure 5:
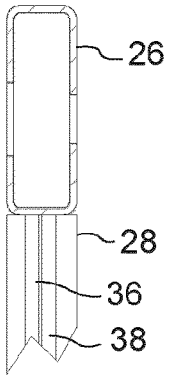
FIG. 5 shows a partial cross section view according to the line V-V defined in FIG. 3.
Figure 6:
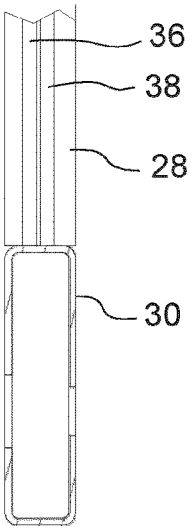
FIG. 6 shows a partial cross section view according to the line VI-VI defined in FIG. 3.
Figure 4:
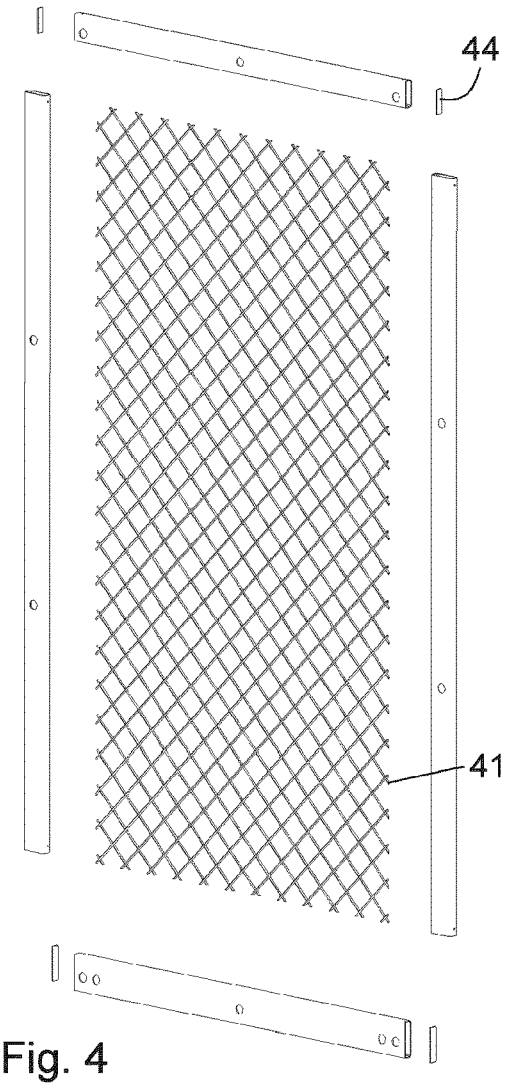
FIG. 4 shows a perspective exploded view of the panel element of FIG. 3.
Figure 10:
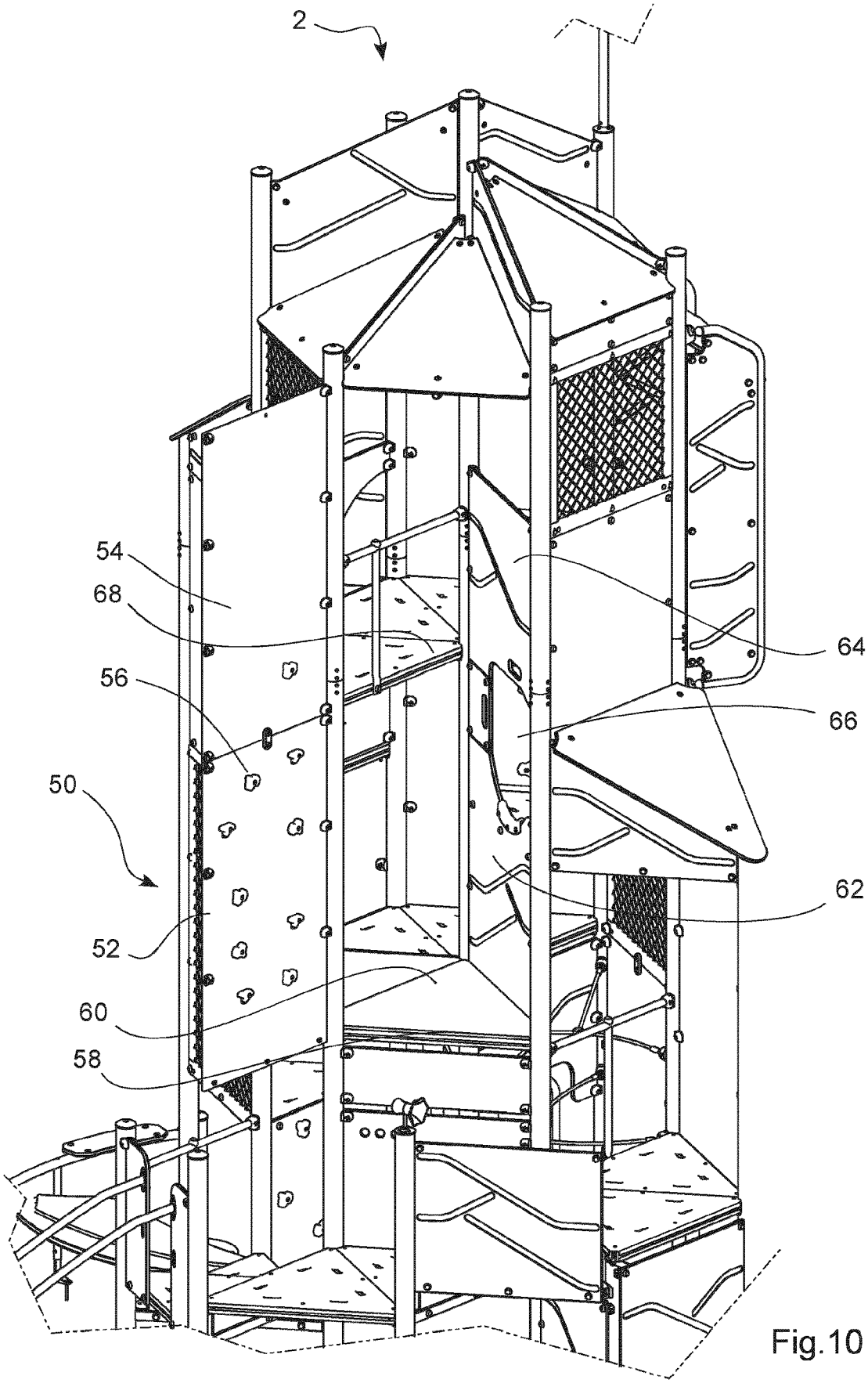
FIG. 10 schematically shows a portion of the play structure of FIG. 1, but where a portion of the play structure has been opened up to show the inside of the play structure.

FIGS. 1, 2 and 10 show different views of the same play structure 1. The play structure is a tall climbing structure comprising a central tower 2 mainly built up of vertically arranged pillars 4, vertically arranged panel elements 6 fastened to the pillars to form wall panels and horizontally arranged panel elements 8 to function as floor panels. Different additional functional elements are connected to the structure to provide different activities. Two examples are slides 10 and rope bridges 12. The play structure also comprises other elements which will not be described in detail here as these elements should be known to the person skilled in the art.

The play structure 1 shown in the figures further comprises a number of mesh panels 20. These mesh panels are placed strategically in the structure so that wind can pass through them. This ensures that the wind loads on the structure can be reduced even when high wind speeds are experienced. Furthermore, the open nature of the mesh panels ensures that children climbing inside can look out and get a feeling of the height of the structure as well as letting parents or other caretakers, standing on the ground, follow the progress of the children as they climb. The mesh panels are also formed in a way to give strength to the panel such that the mesh panel contributes to the overall strength of the play structure.

The mesh panels, as shown in more details in FIGS. 3-8, comprise a rectangular frame 22 and an inner mesh structure 24. The rectangular frame comprises an upper frame member 26, a right side frame member 28, a lower frame member 30 and a left side frame member 32. The inner mesh structure comprises a number of elongated metal elements 34 arranged in a repeating pattern. The elongated metal elements 34 can be described as comprising a first set of metal elements 36 and a second set of metal elements 38. The first and second set of metal elements are arranged perpendicular to each other and are arranged in each their own layer. The two sets of metal elements cross each other and are welded together at each crossing point 40. In this way, the metal elements cannot displace with respect to each other. The ends 41 of the metal elements are welded to the frame members. Each metal element is connected to two frame members. In the current embodiment, the metal elements are arranged at an angle of 45 degrees to the frame members. In this way, the metal elements form a strong internal mesh structure which can provide a great amount of strength to the panel element since the elongated metal elements run along the lines of tension in the panel.

Figure 7:
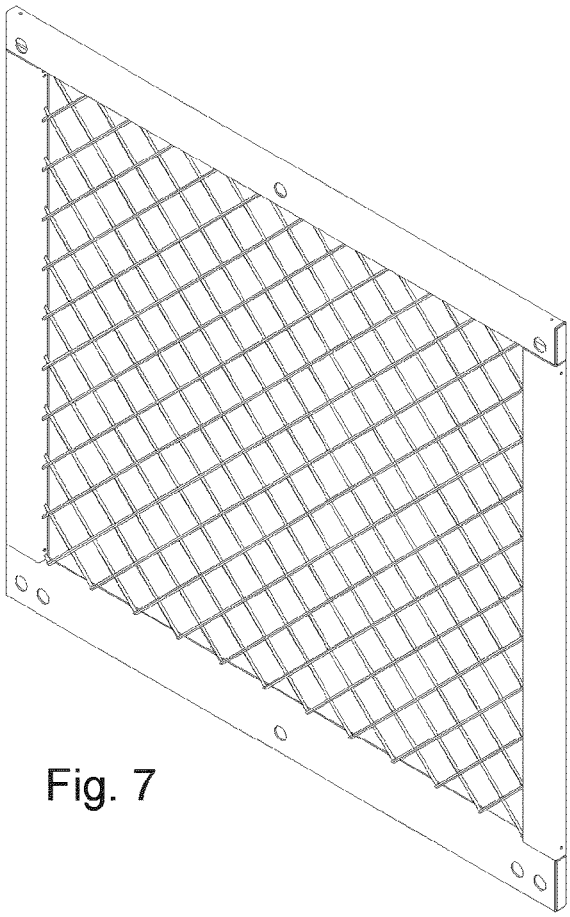
FIG. 7 shows a perspective view of a second embodiment of a panel element.
Figure 8:
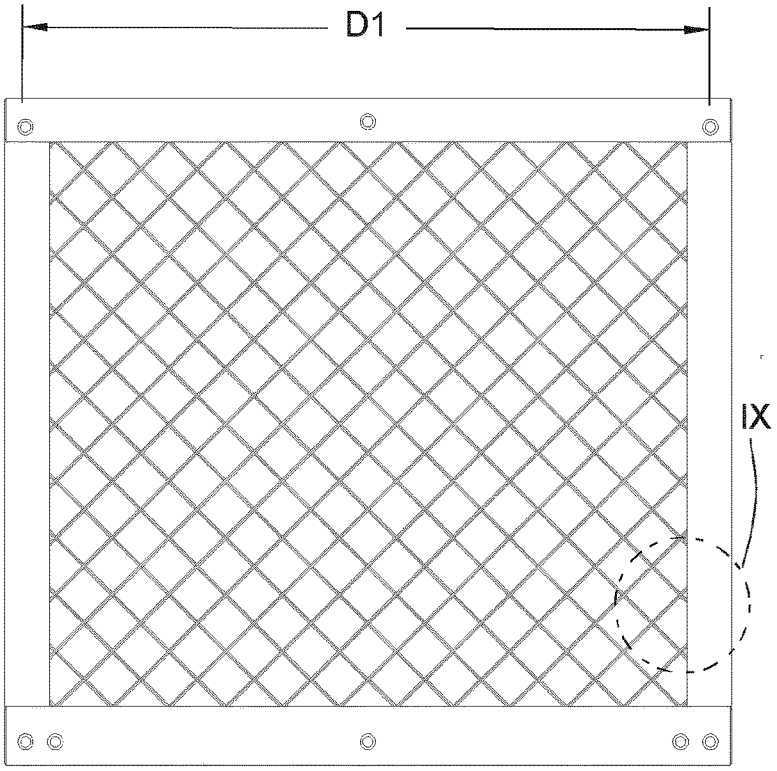
FIG. 8 shows a front view of the panel element of FIG. 7.

FIGS. 3-6 show a panel element which is rectangular and has a height which is greater than its width. FIGS. 7 and 8 shows another panel element which is more square and has a height which is slightly less than its width. Mesh panel elements could be formed in many different sizes.

Figure 9:
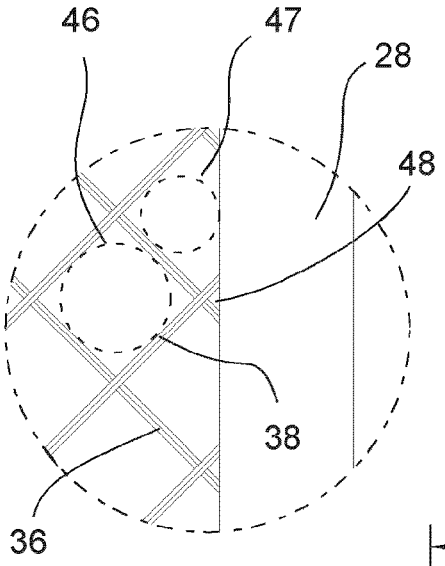
FIG. 9 shows a detail view of the panel element of FIG. 7 according to the circle IX defined in FIG. 7.

FIG. 9 shows a detail view of the mesh panel element of FIGS. 7 and 8, but for the most part, the detail view of FIG. 9 could also be from the panel of FIGS. 3 to 6. In this case, two inscribed circles are shown for two different openings in the mesh structure. The first inscribed circle 46 is shown between four adjacent elongated metal elements 36, 38. The second inscribed circle 47 is smaller and is shown between two elongated metal elements and a frame member 28. Another opening 48 is even smaller. In the current embodiment all the openings are greater than 25 mm or smaller than 8 mm in diameter. In this way, it is difficult to get fingers caught in the mesh.

Of interest in this embodiment is that the mesh panel element is formed as a rectangular panel element, similar to the other panel elements in the system and with mounting holes 42 which are also similar to the other panel elements in the system. The other panel elements could be made of wooden plates or in some cases transparent plastic plates with prints on the surfaces. Since the mounting holes and patterns are similar, the same mounting fittings can be used to mount the mesh panels and the other panels to the pillars. For example, the horizontal distance D1 between the mounting holes along the sides of the mesh panels are the same as for the other panels. In this way, a mesh panel and a normal panel can be easily mounted to the same two pillars, one above the other. This is shown in many locations in the structure of FIG. 1.

The frame members in the current embodiment are made from extruded closed profiles, but could also be made from folded metal plate elements. End plates 44 are provided to close the open profiles. The elongated elements can also be extruded wire elements. In the current embodiment, the elongated elements have a circular cross section with a diameter of around 4 mm. The elongated elements and frame members are made from galvanised steel in this embodiment, but could also be made from other forms of materials or other forms of surface treatment. In one example the elongated elements and the frame members could be powder coated.

The play structure 1 of FIGS. 1, 2 and 10 further discloses a second invention, namely a climbing wall arrangement 50, arranged inside the central tower 2. This climbing wall arrangement could be the subject of a divisional application or combined with the mesh panel of the current invention.

Since the climbing wall arrangement is inside the tower, it is difficult to see from the outside. Hence, in FIG. 10, the panels of the climbing wall arrangement have been rotated outwardly about the vertical axis of the left pillar, when compared to FIG. 1 so that the climbing wall arrangement inside the tower can be seen.

In this embodiment, the climbing wall arrangement comprises a first lower wall panel 52, a second upper wall panel 54, a set of climbing holds or grips 56 attached to the first and second wall panels and a floor panel 58 arranged at the bottom of the wall panels. A planar fall cushioning element 60 is provided on top of the floor panel 58. The planar fall cushioning element could be provided in many different forms, for example a foam mattress, or a plastic fall absorbing pad. The first and second wall panels 52, 54 in this embodiment are provided as transparent plastic panels, similar to glass panels such that light can pass through the panels. Furthermore, when climbing on the panels, the child can see right through the panels. This gives an interesting feeling when climbing inside the tower on a transparent panel.

While climbing walls are known in the art, it is common to put the climbing wall on the outside of the structure. For tall structures like the one shown in the figures, it is not desired to put a climbing wall on the outside of the structure, as a fall from the upper portion of the structure could be fatal. Likewise, it has not been known to arrange a climbing wall inside an upper portion of a tower section. In certain cases, a climbing section has been arranged inside a play structure, but in these cases, the climbing grips have been arranged on a lower portion of the structure so that should a child fall from the climbing section, the child would fall to the ground which was provided with suitable fall cushioning, for example sand or other form of absorbing surface.

In the figures, a further lower wall panel element 62 and a further upper wall panel element 64 are arranged adjacent the climbing wall panels 52, 54. An opening 66 is provided between the further wall panel elements 62, 64. A child climbing up the climbing wall can "exit" the climbing wall by exiting through the opening 66. Instead of exiting through the opening, a child can also "enter" the climbing wall by climbing in through the opening. At an upper end of the climbing wall, the structure also comprises an upper floor panel element 68. The child can thereby climb up the climbing wall and then exit the wall via the upper floor panel. Likewise the child can enter the climbing wall via the upper floor panel.

It is to be noted that the figures and the above description have shown the example embodiments in a simple and schematic manner. Many of the specific mechanical details have not been shown since the person skilled in the art should be familiar with these details and they would just unnecessarily complicate this description. For example, many of the specific materials used and the specific manufacturing procedures have not been described in detail since it is maintained that the person skilled in the art would be able to find suitable materials and suitable processes to manufacture the structure according to the current invention.

The invention claimed is:

1. A play structure for children, said play structure being a tall climbing structure comprising:

a central tower mainly built up of a plurality of vertically arranged pillars, the plurality of vertically arranged pillars including two vertically arranged pillars;

vertically arranged panel elements fastened to the plurality of vertically arranged pillars to form wall panels, the vertically arranged panel elements including a first vertically arranged panel element and a second vertically arranged panel element, the first vertically arranged panel element connected between the two vertically arranged pillars; and horizontally arranged panel elements to function as floor panels;

wherein each of the two vertically arranged pillars is longer than 2 m, and said first vertically arranged panel element is arranged such that its upper edge is located higher than 2 m from a bottom of the two vertically arranged pillars, wherein said first vertically arranged panel element comprises a rectangular frame comprising a top and a bottom horizontally arranged frame member and a left and a right vertically arranged frame member, said top, bottom, left and right frame members together defining an enclosed area, said enclosed area being greater than 0.5 m2 and said enclosed area being filled with a mesh structure made from elongated metal elements arranged in a repeating pattern, each of the elongated metal elements being fastened to at least two different frame members of the top, bottom, left, and right frame members, and wherein a diameter of a largest inscribed circle between any adjacent frame members of the top, bottom, left, and right frame members and/or elongated metal elements is either i) less than 65 mm and greater than 20 mm, or ii) less than 11 mm.

2. The play structure according to claim 1 wherein said elongated metal elements are arranged at an angle to the top, bottom, left, and right frame members to which they are connected to of between 30 and 60 degrees.

3. The play structure according to claim 1, wherein the elongated metal elements are extruded metal profiles.

4. The play structure according to claim 1, wherein the elongated metal elements comprise a first set of elongated metal elements extending in a first direction and a second set of elongated metal elements extending in a different direction, an angle between the elongated metal elements of the first and second sets of elongated metal elements being between 60 and 90 degrees.

5. The play structure according to claim 4, wherein the elongated metal elements are joined together where they cross each other so that the elongated metal elements do not displace with respect to each other at their point of crossing.

6. The play structure according to claim 5, wherein the elongated metal elements are welded together where they cross each other.

7. The play structure according to claim 1, wherein the elongated metal elements are fastened to the top, bottom, left, and right frame members by welding.

8. The play structure according to claim 1, wherein said second vertically arranged panel element comprising a panel of wood or plastic, said first and second vertically arranged panel elements both being provided with mounting fittings for attaching the first and second vertically arranged panel elements to the plurality of vertically arranged pillars, the mounting fittings of the first and second vertically arranged panel elements being of a same kind such that a connection between the first vertically arranged panel element and the plurality of vertically arranged pillars and a connection between the second vertically arranged panel element and the plurality of vertically arranged pillars are formed in a same way.

9. A play structure for children, comprising three vertically arranged pillars, two vertically arranged wall panels connected between the three pillars and a first horizontally arranged floor panel connected between the three pillars, said first floor panel being arranged below an upper edge of the two vertically arranged wall panels, wherein:

a. at least one of the two vertically arranged wall panels comprises multiple spaced apart climbing holds to provide a climbing wall, b. said climbing holds are arranged on a surface of one of the vertically arranged wall panels which faces the other one of the vertically arranged wall panels, and the surface is arranged on a same side of the wall panel as the first floor panel, c. said climbing holds are arranged above the first floor panel, and in that d. said play structure comprises a fall cushioning element arranged on said first floor panel.

10. The play structure according to claim 9, wherein each of said three vertically arranged pillars is longer than 2 m, and each of said two vertically arranged wall panels is arranged such that its upper edge is located higher than 2 m from a bottom of the three vertically arranged pillars, wherein each of said vertically arranged wall panels comprises a rectangular frame comprising a top and a bottom horizontally arranged frame member and a left and a right vertically arranged frame member, said top, bottom, left and right frame members together defining an enclosed area, said enclosed area being greater than 0.5 m2 and said enclosed area being filled with a mesh structure made from elongated metal elements arranged in a repeating pattern, each of the elongated metal elements being fastened to at least two different frame members, and wherein a diameter of a largest inscribed circle between any adjacent frame members and/or elongated metal elements is greater than 20 mm or less than 11 mm.

11. The play structure according to claim 9, wherein the wall panel to which the climbing holds are attached is a translucent panel.

12. The play structure according to claim 9, wherein a third wall panel is arranged along one side of the wall panel to which the climbing holds are attached, said third wall panel arranged at an angle of between 60 and 120 degrees to the climbing wall panel.

13. The play structure according to claim 12, wherein an opening is formed in the third wall panel through which a child can access the climbing wall.

14. The play structure according to claim 13, wherein a lower portion of the opening is arranged at least 1 m above the first floor panel.

15. The play structure according to claim 9, wherein the play structure further comprises a second floor panel arranged above the first floor panel, said second floor panel being arranged horizontally offset from the first floor panel or being provided with an opening such that a child can climb from the first floor panel to the second floor panel via the climbing wall.

16. The play structure according to claim 15, wherein the second floor panel is arranged at least 2 m above the first floor panel.

17. The play structure according to claim 9, wherein a highest climbing grip is located at least 2 m, at least 3 m or at least 4 m above the first floor panel.

18. The play structure according to claim 9, wherein the first floor panel is arranged at least 1 m above the ground.

* * * * *